US006332953B1

(12) United States Patent
Singh et al.

(10) Patent No.: US 6,332,953 B1
(45) Date of Patent: Dec. 25, 2001

(54) PAPER PRODUCT HAVING ENHANCED PRINTING PROPERTIES AND RELATED METHOD OF MANUFACTURE

(75) Inventors: Kapil Mohan Singh, Erie, PA (US); Alexander A. Koukoulas, Ridgewood, NJ (US); Dennis W. Anderson, Middletown, NY (US); Phillip Norrdahl; Douglas L. Hamilton, both of Loveland, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/479,367

(22) Filed: Jan. 7, 2000

Related U.S. Application Data

(63) Continuation-in-part of application No. 09/165,947, filed on Oct. 2, 1998.

(51) Int. Cl.[7] ..... D21H 11/00; D21H 13/00; D21H 23/00

(52) U.S. Cl. ..... 162/134; 162/135; 162/136; 162/137; 162/123; 162/125; 162/129; 162/147

(58) Field of Search ..... 162/123, 125, 162/129, 135, 137, 136, 147, 134

(56) References Cited

U.S. PATENT DOCUMENTS

| | | | | |
|---|---|---|---|---|
| Re. 31,923 | | 6/1985 | Justus et al. | 162/358 |
| 2,991,825 | | 7/1961 | Hampson . | |
| 4,287,021 | | 9/1981 | Justus et al. | 162/358 |
| 4,518,460 | | 5/1985 | Hauser et al. | 162/361 |
| 4,563,245 | | 1/1986 | Wanke et al. | 162/358 |
| 4,673,461 | | 6/1987 | Roerig et al. | 162/205 |
| 4,705,602 | | 11/1987 | Dahl | 162/358 |
| 4,749,445 | | 6/1988 | Vreeland | 162/206 |
| 4,880,501 | | 11/1989 | Schiel | 162/358 |
| 4,931,142 | | 6/1990 | Steiner et al. | 162/358 |
| 5,080,758 | * | 1/1992 | Horng | 162/130 |
| 5,163,364 | | 11/1992 | Bubik et al. | 100/38 |
| 5,223,100 | | 6/1993 | Schiel et al. | 162/358.3 |
| 5,378,497 | | 1/1995 | Johnson et al. | 427/211 |
| 5,400,707 | | 3/1995 | Neider et al. | 100/93 RP |
| 5,483,873 | | 1/1996 | Koivukunnas et al. | 100/38 |
| 5,524,532 | | 6/1996 | Koivukunnas et al. | 100/38 |
| 5,614,064 | | 3/1997 | Nykopp | 162/358.3 |
| 5,750,259 | | 5/1998 | Neider et al. | 428/411.1 |
| 5,753,084 | | 5/1998 | Bubik et al. | 162/358.3 |
| 5,755,931 | | 5/1998 | Schiel | 162/206 |
| 5,784,955 | | 7/1998 | Conrad | 100/329 |
| 5,816,146 | | 10/1998 | Wagner et al. | 100/327 |
| 5,836,242 | | 11/1998 | Aberg | 100/327 |
| 5,865,955 | | 2/1999 | Ilvespaa et al. | 162/207 |
| 5,894,679 | | 4/1999 | Kuhasalo et al. | 34/117 |

FOREIGN PATENT DOCUMENTS

| | | |
|---|---|---|
| 3632692 A1 | 4/1987 | (DE) . |
| 0 361 402 A1 | 4/1990 | (EP) . |
| WO 94/05853 | 3/1994 | (WO) . |
| WO 94/28239 | 12/1994 | (WO) . |
| WO 96/28609 | 9/1996 | (WO) . |

OTHER PUBLICATIONS

Smoothness of paper and paperboard (Sheffield method), T 538 om–88, TAPPI, 1988.

Roughness of paper and paperboard (Print–surf method), T 555 om–94, TAPPI, 1993.

Calendering of coated paper and board in an extended soft nip, M. Wikstrom et al., Nordic Pulp and Paper Research Journal, pp. 289–298, vol. 12, No. 4/1997.

Soft calendering makes hard process on raising quality, Erik Nykopp, Pulp and Paper Industry.

* cited by examiner

*Primary Examiner*—Stanley S. Silverman
*Assistant Examiner*—Dionne A. Walls
(74) *Attorney, Agent, or Firm*—Ostrager Chong & Flaherty LLP

(57) ABSTRACT

A paper product suitable for use in making envelopes and the like and having enhanced printability. The enhancement in printability is attained through the use of shoe nip calendering. The final product has the following material properties: (1) a basis weight in the range 16–32 lb./1,300 $ft^2$; (2) a density equal to or less than 0.75 g/cc; (3) a smoothness as measured by the Hagerty/Sheffield test (TAPPI Test Method T 538 om-88) greater than 200 Sheffield units; and (4) a Parker Print Surf roughness as measured by the Parker test (TAPPI Test Method T 555 om-94) less than 5.0 microns (measured using a pressure of 10 $kgf/cm^2$ with a soft backing).

11 Claims, 10 Drawing Sheets

PAPER PRODUCT HAVING ENHANCED PRINTING PROPERTIES AND RELATED METHOD OF MANUFACTURE

RELATED PATENT APPLICATION

This is a Continuation-in-Part of U.S. patent application Ser. No. 09/165,947 filed on Oct. 2, 1998.

FIELD OF THE INVENTION

This invention generally relates to calendering of paper to improve smoothness while minimizing bulk reduction. In particular, the invention relates to calendering of envelope paper.

BACKGROUND OF THE INVENTION

One of the challenges for achieving optimum printability of paper has been the ability to control independently the surface and bulk properties of the paper. This is particularly true in the calendering process, in which the paper manufacturer attempts to improve the surface properties of the sheet but in doing so, affects the bulk properties. Calendering is known to densify the paper, which changes the physical properties (e.g., opacity, porosity and stiffness) of the paper.

In view of the foregoing, alternative methods for improving the smoothness of the board without sacrificing bulk and stiffness are of interest. Smoothness can be developed by allowing the cellulose fibers to replicate a smooth finishing surface. This can be accomplished by heating the fibers to a temperature higher than the glass transition temperature of the fibers and pressing the fibers to a smooth surface. On the other hand, bulk preservation is expected to be better at lower temperatures, where the web is relatively incompressible.

Almost 100% of the in-line printing of envelopes uses a water-based flexographic process and this constitutes more than 80% of all printing done on envelopes. The advantages to using the flexographic process are higher productivity rates and lower costs for the converter. The disadvantages include relatively poor print quality compared to off-line lithographic printing processes. Coated paper grades print well in a flexographic process, but due to ink drying issues and slipperiness, suffer productivity losses when compared to uncoated papers. Thus there is a demand among envelope converters for a sheet that runs like uncoated paper but prints like coated paper.

As used herein, "coated paper" refers to a paper product to which at least 8 grams per square meter of coating color solids have been applied to at least one surface at a coating station. Examples of common coating stations include blade coaters, rod coaters, short dwell applicator coaters, gate roll coaters, film press coaters, fountain coaters, and the like. The mixture of coating color will generally consist of (1) pigment(s) such as clay, calcium carbonate, titanium dioxide, and the like, (2) binder(s) such as modified starch, styrene butadiene rubber, polyvinyl acetate, vinyl acrylic, or polyvinyl alcohol, and (3) various functional additives such as dispersants, viscosity modifiers, crosslinking agents, lubricants, and the like. The resulting mixture is applied at a mixture solids content of 40% or greater by weight, and means are provided for controlling the amount of dry coat weight applied. A size press operation applying a mixture of starch and pigment to the sheet may or may not be used prior to the coating station.

The term "uncoated paper", as used in the written description and the claims herein, is defined as any paper product which has 0 to 8 grams per square meter of a starch or starch/pigment mixture solids applied to one or both sides of the web, but which does not undergo subsequent surface application as described above. "Uncoated paper" thus may or may not undergo treatment at the size press. If a starch or starch pigment mixture is applied at the size press, the solids content of the mixture for "uncoated" paper will be less than 40% by weight.

In order to attain the micro-smoothness required for good flexographic plate contact, conventional papermaking processes tend to compress the sheet, sacrificing bulk, stiffness and converting performance. Since envelope conversion generally requires only one side to be finished, a process which could treat one surface while preserving sheet bulk would be desirable.

Temperature gradient calendering is a known process where the surface of the paper is heated to a temperature higher than the glass transition temperature of the cellulose in the nip while the temperature of the sheet is substantially cooler. This process enables smoothness development with reduced bulk loss compared to regular machine calendering. In addition, surface moisturization can also be used to lower the glass transition temperature preferentially closer to the surface to develop smoothness with minimum bulk loss.

Soft calendering, another method of calendering used primarily for coated substrates, also relies on the temperature gradient calendering concept but the web that is being pressed against a hot surface in a nip is supported by a roll that has a deformable cover. This cover gives the paper a longer dwell time in the nip compared to hard steel nips and also allows the smoothness and gloss development to occur at relatively uniform density across the width of the paper. Soft calendering is an expensive option for existing machines and has limitations, such as cover delamination and cracking due to overheating.

Extended nip calendering extends the soft calendering concept to longer nip widths and reduces the operational problems. One type of extended nip calendering uses an endless band/belt over a backing roll to provide support for a paper web that is pressed against a heated cylinder. Another variation to this concept is to use a shoe instead of a roll as a backing for the paper web. The backing shoe provides longer nip widths and hence an increased dwell time.

SUMMARY OF THE INVENTION

The present invention comprises an uncoated paper product suitable for use in making envelopes and having enhanced printability. In particular, the invention comprises envelope paper having the following material properties: (1) a density equal to or less than 0.75 g/cc; (2) a smoothness as measured by the Hagerty/Sheffield test (TAPPI Test Method T 538 om-88) greater than 200 Sheffield units; and (3) a Parker Print Surf roughness as measured by the Parker test (TAPPI Test Method T 555 om-94) less than 5.0 microns (measured using a pressure of 10 kgf/cm$^2$ with a soft backing).

The invention further comprises a method of finishing printing paper using shoe nip calendering, which is superior to conventional calendering and provides a finished product having improved print performance and/or bulk. The method is applicable to envelope paper products in the basis weight range of 16 to 32 lb./1300 ft$^2$ and having a density equal to or less than 0.75 g/cc.

In accordance with the preferred method of manufacture, after drying in the main section the paper web is passed through a size press (e.g., puddle or metering including rod or blade) where the amount of pickup can be controlled. The size-press-treated paper is dried in the after section to a moisture level of 4–6%. Following the size press treatment, the paper may be remoisturized using water showers (hydraulic, air atomized, ultrasonic) or steam showers on one or both sides of the paper. The amount of moisture addition will be approximately in the range 0.25–6% by weight per side. Preferably, the web exiting the after-dryer section region (average temperature 100°–180° F.) is moisturized on the surface to be calendered using a steam shower. In addition to moisturization, the steam shower may also raise the temperature of the surface of the sheet. The preferred range for steam application is 0.5 to 5 g/m$^2$ applied to the web surface.

Following the last dryer section, the web is calendered in one or more nips of an extended nip belt calender. The calender includes a heated roll against which the surface that is being smoothed is pressed using a roll-backed or shoe-backed soft belt to support the web. Shoe backing is preferred. The extended-nip belt calender may be installed in place of the calender stack or retrofitted from an existing machine calender. Retrofitting is an economical option compared to installing a new calender. The heating in the belt calender rolls can be accomplished by any known processes, including internal induction, hot oil circulation, external induction, steam heating, direct heating, infrared heating and other such means. The heating process is designed to maintain the surface of the calendering rolls at a temperature of at least 120° C. The nipload applied in the heated nips is preferably in the range from 250 to 450 kN/m for a 70 mm shoe with a nip width of 1 to 25 cm. The effective nip pressure can be reduced as the length of the shoe is increased. The preferred shoe length is 30–100 mm.

Envelope paper is made conventionally but finished with a combination of conventional calendering and shoe nip calendering. The temperature of the hot roll in the shoe nip calender, the pressure in the nip, and the extent of steam application prior to the nip all affect the extent of enhancement in flexographic print quality of envelope paper. Other factors, such as the temperature of the sheet going into the shoe calender and the extent of precalendering, also play a role.

DETAILED DESCRIPTION OF THE PREFERRED EMBODIMENTS

The present invention relates to the finishing of uncoated envelope paper made from bleached, semi-bleached or unbleached fibers. As used herein, the term "envelope paper" means paper having the following material properties: (1) basis weight—16–32 lb./1,300 ft$^2$; (2) MD Gurley stiffness—60–500 mgf; and (3) CD Gurley stiffness —30–350 mgf. The Gurley stiffnesses were measured in accordance with TAPPI Test Method T 543 om-94.

Figure 1:
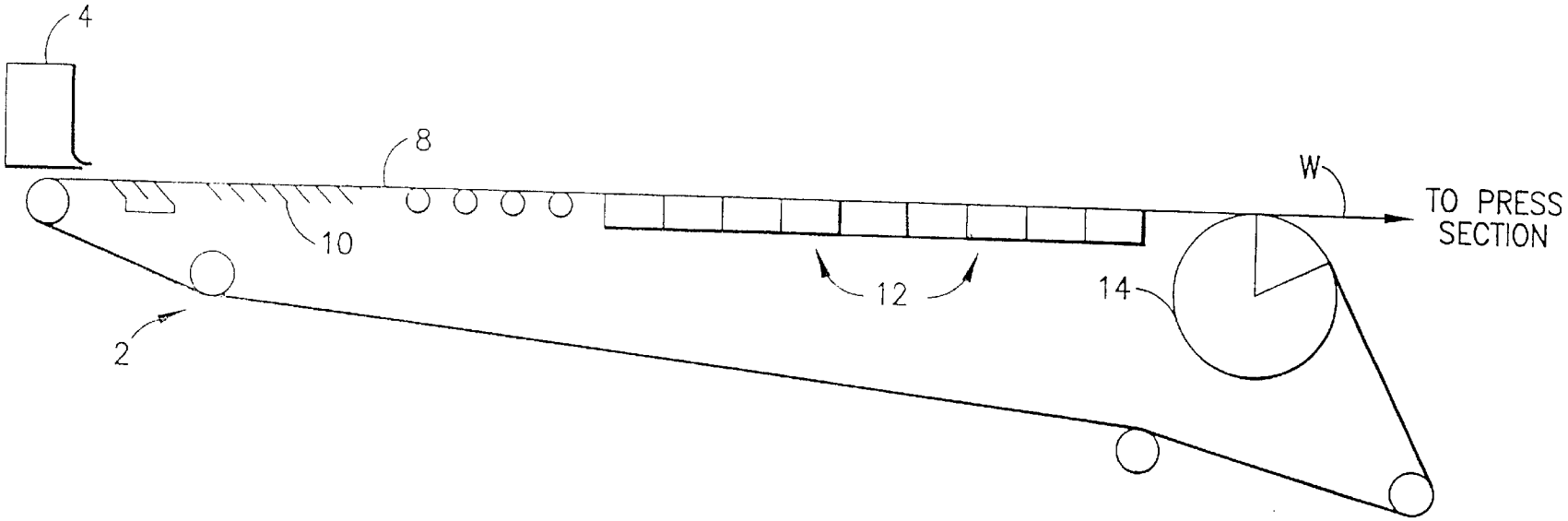
FIG. 1 is a diagrammatic view of a typical arrangement of a Fourdrinier machine suitable for use in manufacturing paper.

Referring to FIG. 1, envelope paper can be formed on a conventional Fourdrinier machine 2 fitted with a head box 4. The furnish for the headbox 4 is provided by conven-tional means. Headbox 4 deposits the fibers on a forming table 8 of the Fourdrinier machine. At a suitable position along the forming table 8, vacuum is applied using conven-tional suction boxes 12. Water is removed by the foils 10 and by the suction roll 14. The web W exits the Fourdrinier machine and enters a conventional press section (not shown), which removes additional water.

Figure 2:
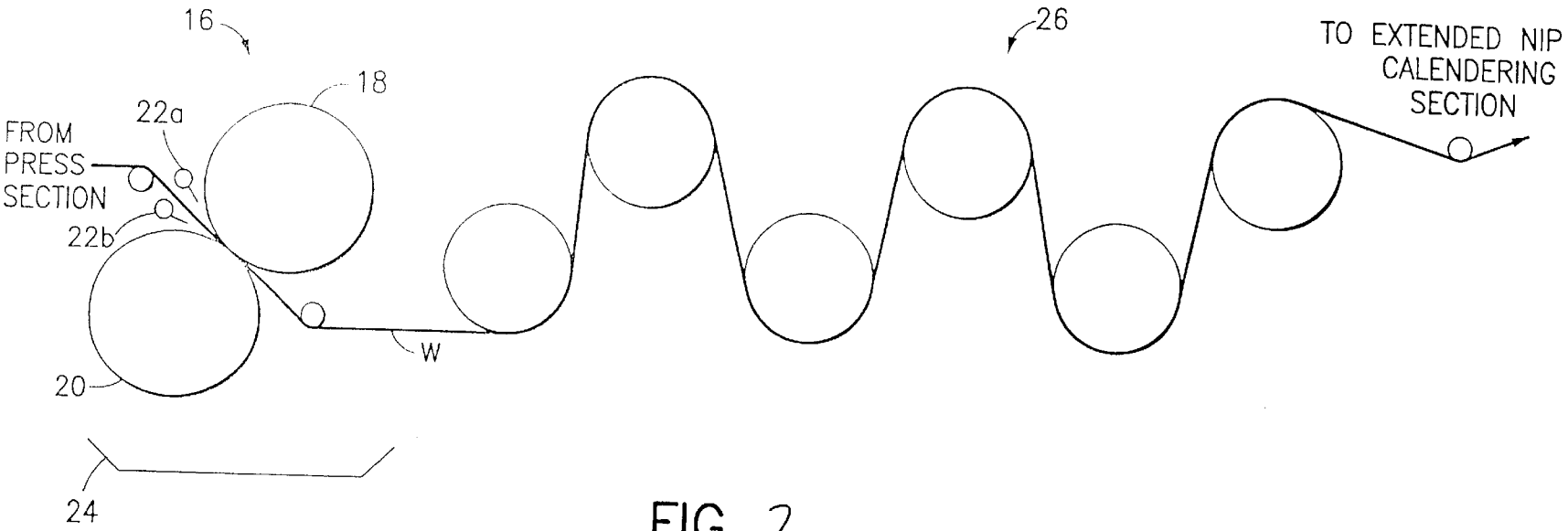
FIG. 2 is a diagrammatic view of a representative size press and dryer section which can be used in manufacturing paper.

Following pressing, the paper web is dried in the main dryer section (not shown) of the papermachine. Referring to FIG. 2, the dried web is then optionally surface sized at a size press 16 (e.g., of the puddle or metering type) where the amount of pickup can be controlled. Sizing operations are carried out primarily to provide paper with surface strength and control of penetration by aqueous solutions. The treatment also improves the surface characteristics and certain physical properties of the paper. During surface sizing, surface voids in the sheet are filled with starch or other binder particles.

FIG. 2 shows a size press 16 having an inclined configuration. However, it will be appreciated by persons skilled in the art that the use of an inclined configuration is not necessary. In the alternative, the size press may be horizontal or vertical or have metering elements such as a rod or blade. In the inclined size press shown in FIG. 3, the web W passes through the nip between a pair of opposing size press rolls 18 and 20 at an angle of inclination between 0 and 90°, e.g., 45°. The nip formed by rolls 18 and 20 is flooded with sizing solution supplied on both sides of the web by respective banks of solution supply tubes 22*a* and 22*b* spaced in the cross machine direction. The web W absorbs some of the solution and the unabsorbed solution is removed by the pressure in the nip. The overflow solution is collected in a pan 24 arranged directly below the press rolls and is recirculated back to the nip through the solution supply tubes.

The size press 16 can be used to add a variety of agents for a variety of purposes (e.g., starch and polyvinyl alcohol for strength, pigments such as calcium carbonate, clay for improving the brightness and smoothness of the product). The starch solution (e.g., unmodified, acid modified, preoxidized or hydroxyethylated) may have a starch concentration in the range of 1–25%. In addition, the size press solution may optionally contain a lubricant that is compatible with the starch and other binders. This lubricant can belong to a class of polyethylene emulsions or can be a polyglyceride. The size press-treated paper is dried in the dryer section 26 to a moisture level of 4–6%.

Figure 3:
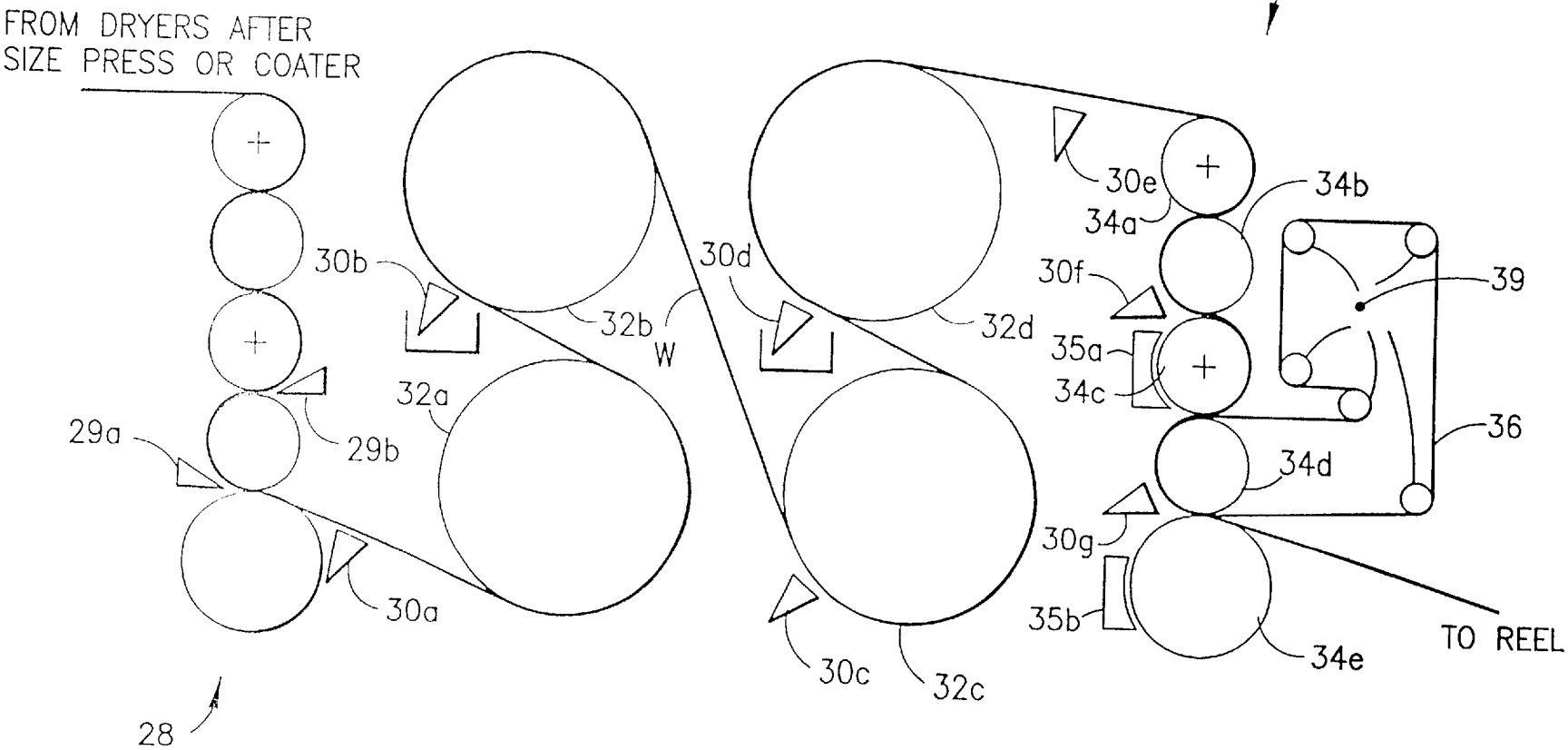
FIG. 3 is a diagrammatic view of a known calendering section of a papermachine which has been retrofitted to an extended nip calendering arrangement for use in finishing envelope paper in accordance with one preferred embodiment of the invention.

Following the size press treatment and drying, the paper is passed through a first multi-roll calender stack 28 shown in FIG. 3. The calender stack 28 may be equipped with one or more conventional waterboxes. FIG. 3 shows a wet stack 28 having two conventional waterboxes 29*a* and 29*b* which conventionally apply water or aqueous solutions to respective sides of the paper. As described in greater detail herein-after, because the machine calendering line shown in FIG. 3 is retrofitted with moisturizing showers, the waterboxes are not used to apply moisture to the paper, i.e., the waterboxes are either removed or left in place but not activated to apply liquid to the paper web. Furthermore, the wet stack 28 is used to pull the web, with the last nip in the wet stack being used for caliper control with minimal loading.

After the paper web W has passed through the stack 28, the web is moisturized on one or both sides using one or more moisturizing showers 30. The moisturizing showers may consist of water showers (e.g., hydraulic, air atomized or ultrasonic showers) or steam showers or combination of water showers and steam showers. In the most preferred embodiment, steam showers are used to apply steam to the web surface in an amount of 0.5 to 5 g/m$^2$.

The web may optionally be wrapped around a pair of intercalender dryers, which can be used as cooling cylinders, in an S-shaped configuration, before entering a dry calender stack 34. Calender stack 34 comprises calender rolls 34*a*–34*e*, at least one of which is heated. The intercalender dryers 32*a* through 32*d* are located between calender stacks 28 and 34, and can be used to cool the web W to reduce the average sheet temperature by circulating cold water or other heat transfer fluid. Alternative means of cooling, such as air showers or cooling cylinders, may be used in place of the existing intercalender dryers. The last one or two intercalender dryers may also be used to raise the surface temperature of the sheet that is to be calendered. The web exits the intercalender region with an average surface temperature in the range of 100° to 180° F.

Each moisturizing shower 30 comprises a bank of independently controlled nozzles which are spaced at regular intervals in the cross direction (CD). The supply of fluid or steam to each nozzle is controlled by a computer (not shown), which receives moisture level feedback from moisture detectors (not shown), e.g., gamma gauges, situated downstream of the moisturizing showers, e.g., at the reel. The computer-controlled nozzles selectively apply moisture to the web to correct for nonuniformities in the CD moisture profile. The amount of moisture addition will range from 0.25–6% by weight per side. While moisture addition may be restricted to the printed side of the board, some moisturization on the opposite side may be required to control curl during the production. The moisture addition will be done in such a way that a uniform moisture level will be applied after the profiling is accomplished. The profiling and moisture addition can be done by a combination of one of more showers. If steam showers are used in conjunction with water showers, the preferred configuration would have the steam showers following the water showers. The location of the moisturizing showers will be such that the dwell time between moisturization and the heated nip location varies between 0.05 and 6 sec. Possible locations of the moisturizing showers 30 are shown in FIG. 3, e.g., shower 30*a* located after calender stack 28 and before the first intercalender dryer 32*a;* showers 30*b*–30*d* respectively located adjacent the second, third and fourth intercalender dryers 32*b*–32*d;* shower 30*e* located after the fourth intercalender dryer 32*d* and before calender stack 34; shower 30*f* located adjacent calender roll 34*b;* and shower 30*g* located adjacent calender roll 34*d.*

In accordance with one preferred embodiment of the invention, a soft, i.e., conformable, endless belt 36 is installed such that the belt is partially wrapped around calender roll 34*d,* which is unheated, to form a first extended nip with calender roll 34*c,* which is heated, e.g., by an external induction heater 35*a.* The belt presses the web against the surface of the heated calender roll. The belt 36 is supported by a plurality of guide rolls 39 and by calender roll 34*d.* Although FIG. 3 shows belt calendering of the wire side of the web, alternative arrangements can be used to calender the felt side instead. For example, the felt side can be calendered by wrapping the belt around calender roll 34*c* and then heating calender roll 34*b* instead of calender roll 34*c.*

In accordance with the preferred embodiment shown in FIG. 3, the calendered side of the web W is moisturized using a moisturizing shower 30*f,* i.e., steam shower. In addition to moisturization, the steam shower will also raise the temperature of the surface of the calendered side of the web. The moisturized side of web W is then smoothed as it passes through the hot extended nip formed by heated calender roll 34*c* and conformable belt 36. The steam shower 30*f* is located very close to the first extended nip between rolls 34*b* and 34*c* so that the time between steam application and hot extended nip calendering is minimized.

Minimizing this time will preserve a gradient in moisture across the thickness of the web. In cases where more than one moisturizing shower is used to apply moisture to the same side, the last shower that applies moisture should be located as close to the extended nip as possible. Preferably the dwell time between the moisturization using the steam shower 30*f* and calendering in the first hot extended nip is 0.01 to 6 sec. The nipload in the heated nip between rolls 34*c* and 34*d* is preferably in the range from 250 to 450 kN/m (for a nip width in the range of 1 to 25 cm). Preferably, the calender roll 34*b* is raised to eliminate the hard nip between rolls 34*b* and 34*c*, so that the finished side of the web will not be steel nip calendered before entering the first hot extended nip.

As depicted in FIG. 3, optionally calender roll 34*e* may also be heated, e.g., by external induction heater 35*b*, to provide a second hot extended nip for further smoothing of the calendered side of the web W. Optionally, the web can be remoisturized by moisturizing shower 30*g* before the web enters the second extended nip formed by heated calender roll 34*e* and conformable belt 36. Because the pressure in each nip is a function of the weight of the calender rolls above that nip, the nip pressure will be greater in the extended nip between belt 36 and roll 34*e* than the nip pressure in the extended nip between belt 36 and roll 34*c* unless an adjustment is made. The niploads in the two extended nips can be equalized by conventional means, e.g., by installing compression springs to partially support roll 34*d*, the spring force being roughly equal to the weight of roll 34*d*.

In accordance with the preferred embodiment of the invention, calender rolls 34*c* and 34*e* may be heated by conventional external induction heater 35*a* and 35*b*, respectively. However, it will be appreciated by persons skilled in the art that other conventional means could be used to heat calender rolls 34*c* and 34*e*. For example, the hot pressure nips can be created by heating one or more of the rolls in the second stack using internal steam, circulating oil or other heating fluid, internal or external induction coils, direct heating or infrared heating. The heat input into the rolls is preferably sufficient to maintain a roll surface temperature of greater than 120° C. during calendering of the web.

Although the calendering line shown in FIG. 3 comprises two calender stacks separated by intercalender dryers, it should be appreciated that to finish the envelope paper, at a minimum, requires only a single calender stack having a single extended nip. Thus, wet stack 28 and intercalender dryers 32*a*–32*d* can be eliminated. Furthermore, the single calender stack could be a simple two-roll calender. When intercalender dryers are present, they are normally used to dry the sheet to lower the moisture that the web picks up in the wet stack. This drying is not needed because the water-boxes on the wet stack are not used. Therefore, the intercalender dryers can be used to cool the sheet by running cold water or other cooling fluid through them. Alternatively, the web may be routed around any of the existing intercalender dryers simply to extend the convective cooling during web travel. The dryers need not be filled with a cooling medium.

In a dry stack retrofitted with an endless belt, the belt is preferably formed using a fabric base and coated using a polymeric material such as a polyurethane. The belt is pre-formed in that it is supplied as a continuous loop. The finished belt preferably has a hardness from 58 Shore A to 88 Shore C and a thickness of 5–15 mm, and preferably is finished to a surface roughness of no greater than 8 $\mu$m RMS. In addition, the uniformity of the belt will be such that the thickness variation across the width of the papermachine will be no greater than 0.02 mm. The loop length of the belt will be optimized to be located in the available space in the dry stack and also have sufficient cooling outside the nip. Installation of endless belts on the calender stack may be an involved procedure. As an alternative to endless bands, the belt can be seamed in place and the seam covered with a material that minimizes marking due to the seam in the calendering operation. The belt physical properties will be chosen such that the nip width can range from 1 to 10 cm or the nip residence time is in the range of 0.001 to 20 msec.

To practice the invention, it is possible to retrofit a conventional machine calendering section by installing a conformable belt. In addition, the conventional machine calendering section may be retrofitted with moisturizing showers and external induction heaters, as shown in FIG. 3.

Figure 4:
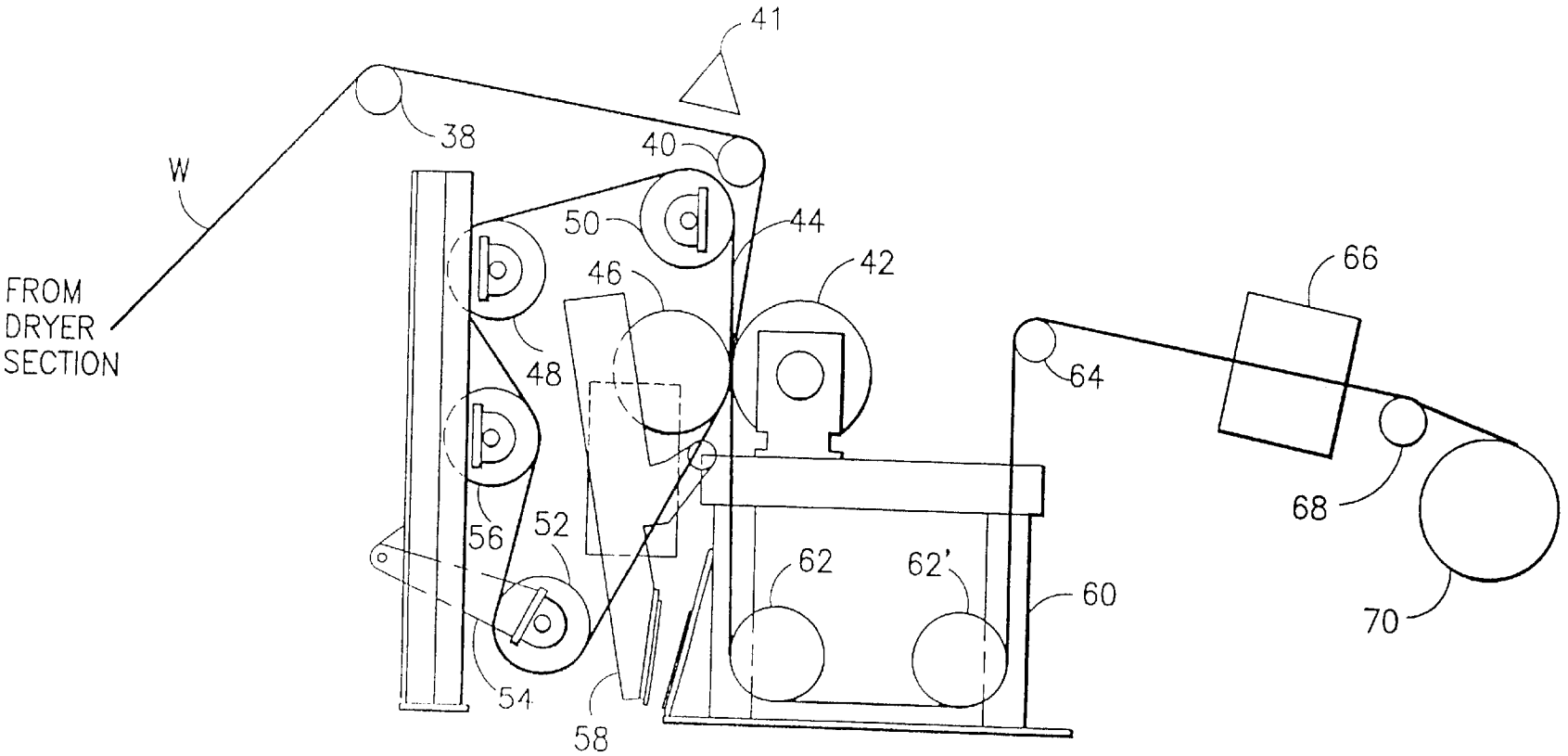
FIG. 4 is a diagrammatic view of an alternative extended nip calendering arrangement which can be used to finish envelope paper in accordance with another preferred embodiment of the invention.

In accordance with a further alternative, the envelope paper may be manufactured by installing a belt calendering arrangement of the type shown in FIG. 4 in place of the dry stack. The belt properties used in a new calender installed in place of an existing dry stack will also be similar to the properties described for the retrofitted calenders. Cooling means other than intercalender dryers, such as cooling cylinders, chill boxes, chill rolls and air showers, can be used to cool the side of the paper which is not contacted by the heated calender roll of the belt calendering arrangement. Use of such cooling means is optional.

Referring to FIG. 4, the tension in the web W can be adjusted by changing the position of a tensioning roll 38 utilizing any conventional tensioning device (not shown). The web is wrapped partly around a guide roll 40 and passes through an extended nip formed by a heated calender roll 42 and a conformable belt 44 made of resilient material. The position of guide roll 40 is adjustable to increase the angle of contact of the web W with the heated calender roll 42 upstream of the extended nip, which angle of contact determines the amount of preheating applied to the web by the heated calender roll. Before entering the nip, the web W is optionally moisturized by a bank of moisturizing showers 41 of the type previously described. The web W is pressed against the heated calender roll 42 by a backing roll 46 which exerts a load on the belt 44. The belt 44, which may be either endless or seamed, circulates on carrier rolls 48 and 50 and tensioning roll 52. The tensioning roll 52 is rotatably mounted on the end of a pivotable arm 54. A guide roll 56 is located outside and in contact with the circulating belt. The backing roll 46 is rotatably mounted on a loading arm 58, which is in turn pivotably mounted on a support frame 60. The loading arm has a first angular position (shown in FIG. 4) in which the backing roll 46 presses the belt 44 against the heated calender roll 42 and a second angular position (not shown in FIG. 4) in which the belt is relaxed and separated from the heated roll by a gap.

The heated calender roll surface, when pressed against the side of the web W that will be printed, applies heat. The residence time of the web in the extended nip is sufficiently short that the heat does not penetrate through the entire thickness of the web. The applied heat raises the surface temperature of the paper to the glass transition temperature, which causes the fibers to soften and conform to the surface of the heated calender roll 42. The gradient in the temperature tends to lower the glass transition temperature preferentially on the side of the web that will be printed, allowing the web to achieve a desired smoothness and a desired printing performance without significant reduction in caliper or stiffness. The calendered web passes under guide rolls 62 and 62' and then over guide roll 64. A scanning sensor unit 66 measures the moisture level and basis weight of the web.

The web then passes over guide roll 68 on its way to a winding roll 70.

Figure 5:
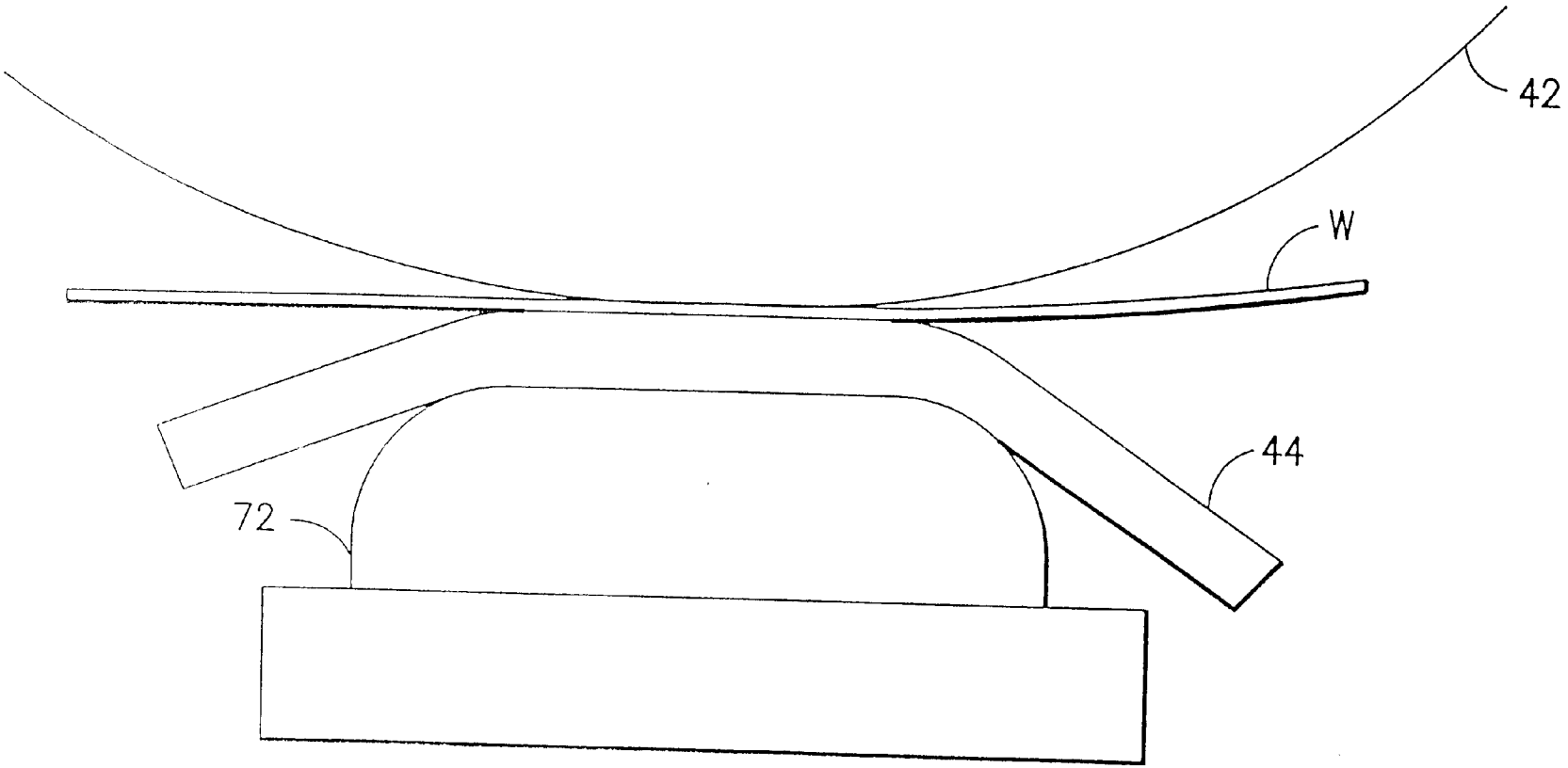
FIG. 5 is a diagrammatic view of an extended nip calendering arrangement in which the conformable belt is supported against the heated calender roll by means of a backing shoe arrangement for use in finishing envelope paper in accordance with a further preferred embodiment of the invention.

In accordance with another preferred embodiment of the envelope paper finishing apparatus, the backing roll can be replaced by a backing shoe to provide a greater nip width. An example of such an extended nip calendering arrangement is depicted in FIG. 5. This shoe nip calendering arrangement comprises a heated calender roll 42, a conformable belt 44 made of resilient material and a backing shoe 72. The backing shoe 72 is urged toward the heated calender roll 42 by means of loading elements (not shown). During belt operation, the belt 44 glides over the contoured surface of the backing shoe. To reduce friction during gliding, lubricating oil is supplied between the bottom surface of the belt and the crown surface of the backing shoe by an oil lubrication system not shown in FIG. 5. The nip width is determined by the width of the crown of the backing shoe, the radius of the heated calender roll and the thickness of the belt.

The results achieved in a shoe nip calender are determined in part by the properties of the belt. In particular, the modulus of elasticity of the belt affects the deformation of the belt in the nip.

Utilizing the apparatus shown in FIGS. 3, 4 or 5 with a hot calender surface temperature in excess of 250° F. and calender nipload which varied from 250 to 450 kN/m, the calendered top surface of various grades of uncoated envelope paper (density equal to or less than 0.75 g/cc) had the following attributes: (1) the smoothness as measured by the Parker test (TAPPI Test Method T 555 om-94) was better (lower) than 5.0 microns when measured using a pressure of 10 kgf/cm$^2$ (soft backing); and (2) the smoothness as measured by the Hagerty/Sheffield test (TAPPI Test Method T 538 om-88) was not less than 200 Sheffield units.

The shoe nip calendering method of the preferred is embodiment significantly improves the microscale smoothness over the macroscale smoothness. Here the term microscale is being used to refer to a scale where roughness can be characterized by the aforementioned test for Parker smoothness while macroscale refers to a length scale where roughness can be characterized using the Sheffield/Hagerty test. The results from the Parker instrument are indicative of the print performance of a product.

The intercalender dryers and moisturizing showers can be used to cool the web prior to shoe nip calendering. It is known that calendering of a cooler web can result in better bulk than calendering a hot web and the practice of temperature gradient calendering is based on this principle. The moisturizing showers provide a rapid method of cooling and also reduce the glass transition temperature, as well as correct for moisture profile nonuniformity.

Figure 6:
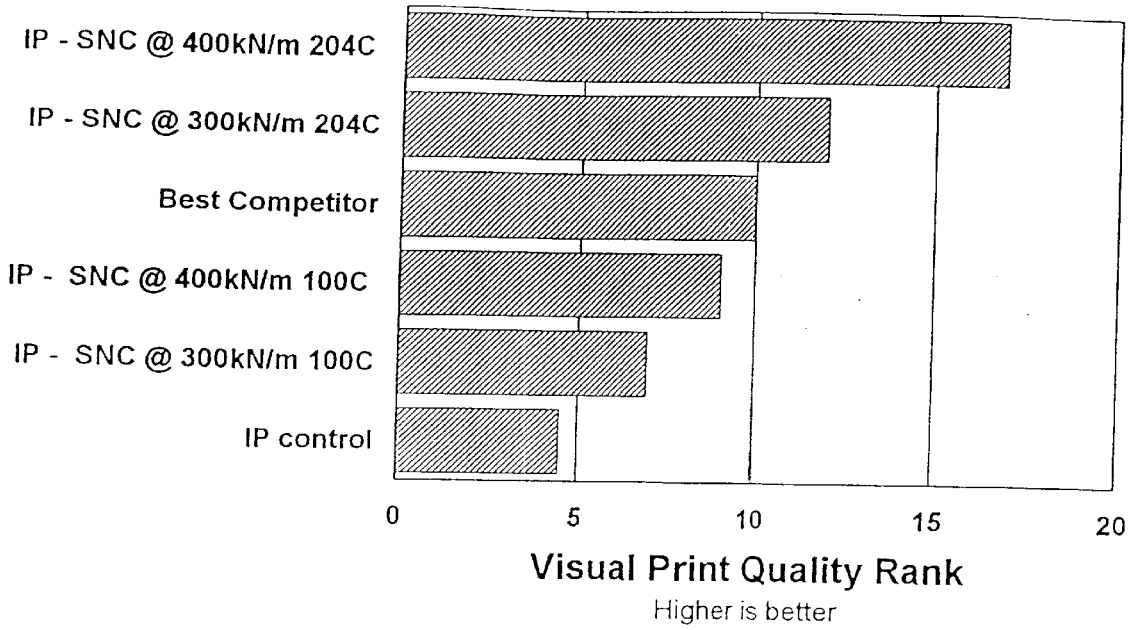
FIG. 6 is a chart showing the improvement in the visual print quality of envelope paper which has been shoe nip calendered.

FIG. 6 shows the relative extent to which envelope flexographic print quality can be improved using shoe nip calendering. A visual print quality scale, ranging from 0 to 10 was established, based on print quality of envelope paper tested in benchmarking studies. A higher number was associated with a higher print quality. The best prior 5 art paper evaluated had a print quality of 10, and the print quality of the control sheet was 4.5. Shoe nip calendering took the control sheet print quality to 17 or more. The control sheet was steel nip calendered.

Figure 7:
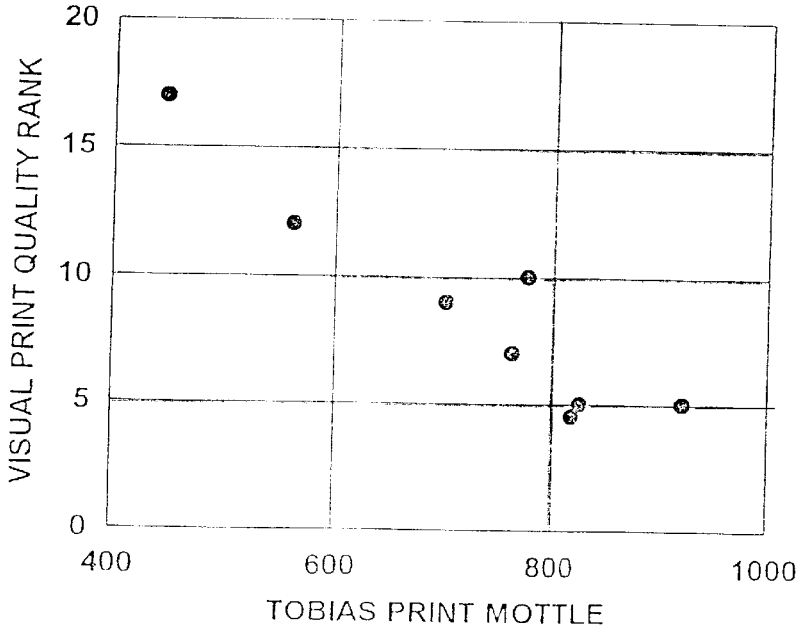
FIG. 7 is a graph showing the correlation between Tobias print mottle and visual print quality ranking for a trial with shoe-nip-calendered envelope paper.

The print quality can also be quantified with the Tobias Print Mottle test, which correlates well with visual ranking of print quality, as long as the printing process is not altered in any way. The correlation for one trial with shoe nip calendering is shown in FIG. 7.

Figure 8:
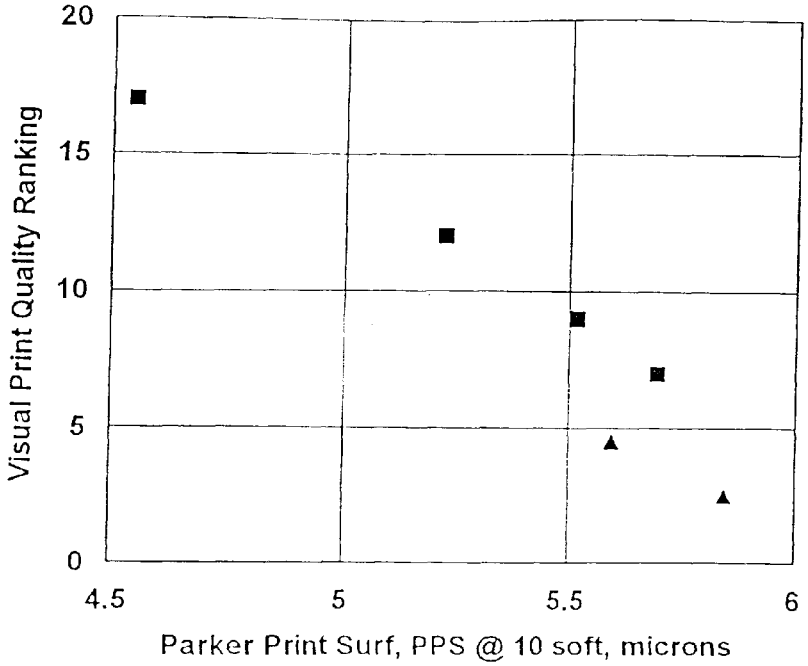
FIG. 8 is a graph showing that reduction in Parker Print Surf roughness (PPS) was closely associated with improvement in flexographic print quality of envelope paper: (σ) hard nip calendering; (■) shoe nip calendering.

Parker Print Surf roughness (PPS at 10 kg, soft backing) correlated well with print quality. This is shown in FIG. 8. The squares represent shoe nip calendering data, while the triangles represent hard nip calendering data.

Figure 9:
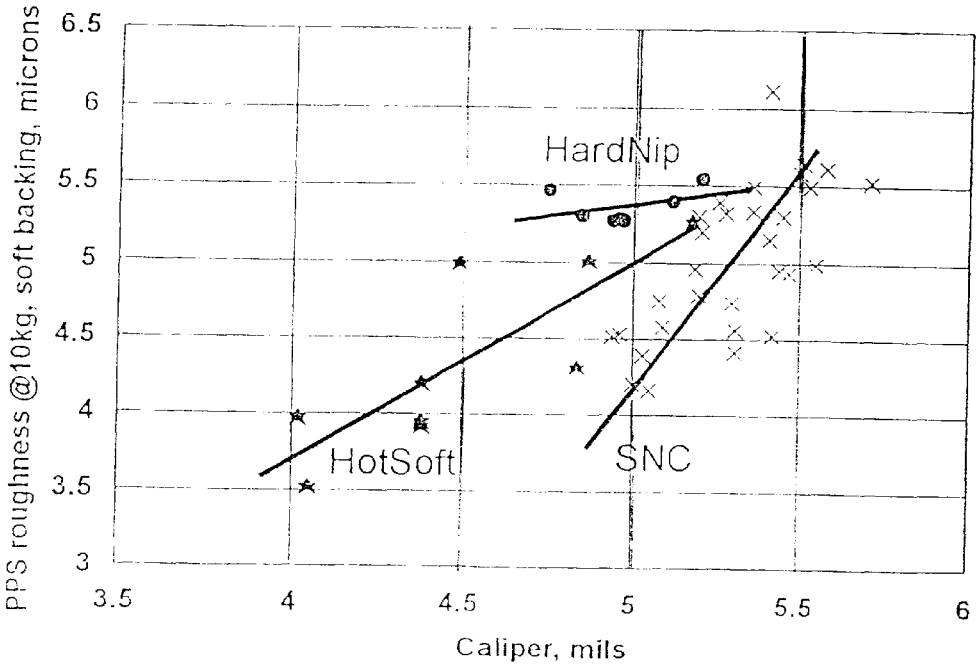
FIG. 9 is a graph showing the effect of conventional steel-on-steel hard calendering (λ), soft nip calendering (H) and shoe nip calendering (5) on caliper or thickness of envelope paper.

FIG. 9 shows the effect of conventional steel-on-steel hard calendering (λ), soft nip calendering (H) and shoe nip calendering (5) on caliper or thickness of envelope paper. Shoe nip calendering retained caliper more than soft nip calendering, at equivalent levels of Parker Print Surf roughness. Hard nip calendering aggressively lowers caliper with minimal gain in PPS roughness reduction. Also hard nip and soft nip calendering do not improve print quality even at equivalent PPS roughness level, if one starts out with a badly formed sheet, whereas shoe nip calendering overcomes the effect of bad formation.

Figure 10:
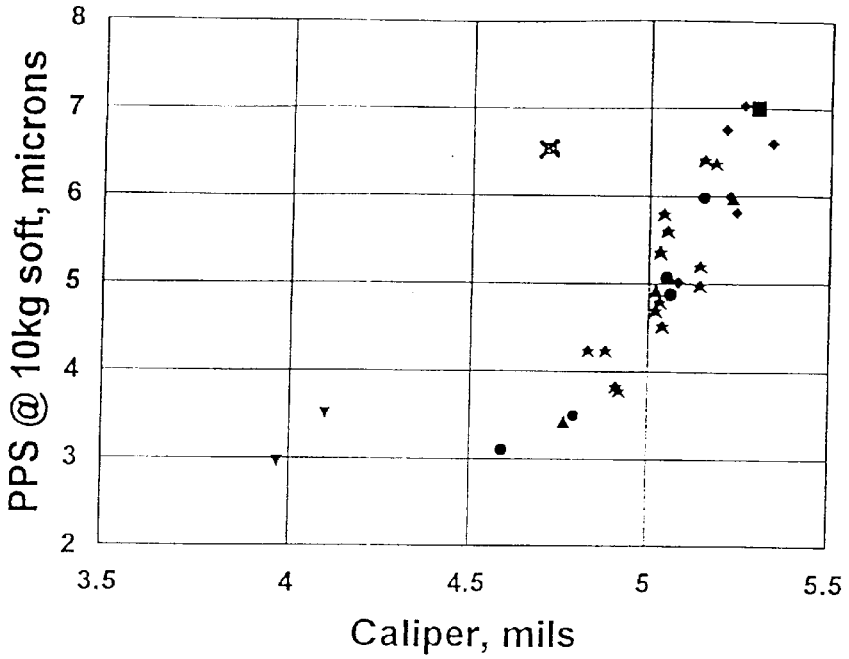
FIG. 10 is a graph of PPS versus caliper which shows that steam application prior to shoe nip calendering can help lower the PPS roughness: (H) shoe nip calendering with 70-mm shoe at fast speed with no steam; (λ) shoe nip calendering with 70-mm shoe at fast speed with 2 g/m$^2$ of steam; (σ) shoe nip calendering with 70-mm shoe at slow speed with no steam; (υ) shoe nip calendering with 275-mm shoe; (τ) hot soft calendering; (5) steel nip calendering; (ν) no calendering.

FIG. 10 shows that steam application prior to shoe calendering reduces PPS roughness even more, thus providing a tool to enhance flexographic print quality even further. The effect of shoe nip length on roughness is also shown, indicating that lower pressure in a longer nip can have a significant effect on the final product.

Figure 11:
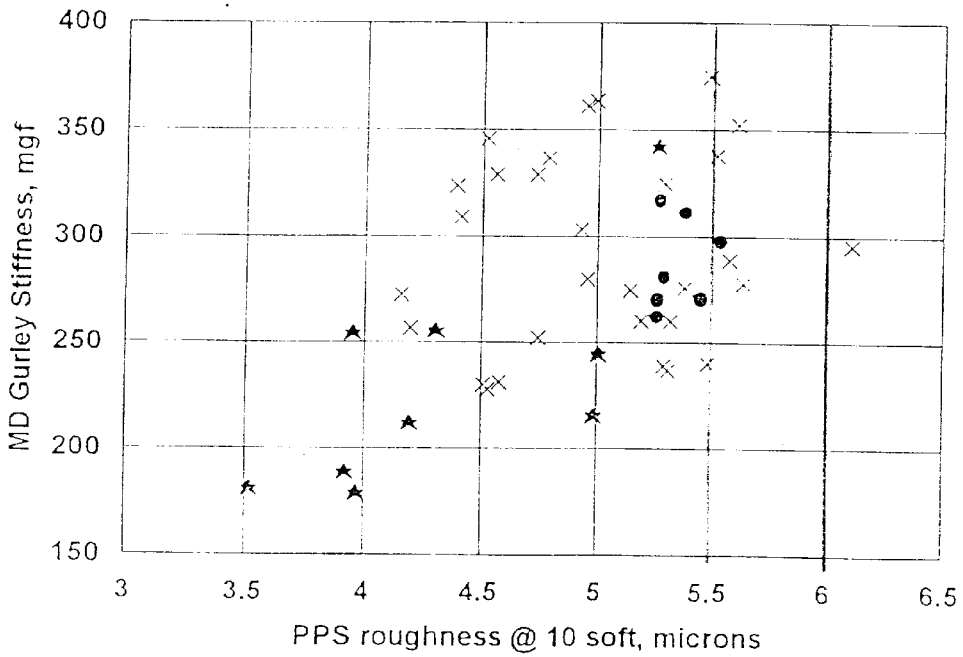
FIG. 11 is a graph showing the effect of conventional steel-on-steel hard calendering (λ), soft nip calendering (H) and shoe nip calendering (5) on stiffness of envelope paper.

A higher paper caliper is expected to provide higher stiffness. Despite variability in stiffness data due to the range of conditions studied, it was observed that under some conditions of shoe nip calendering, an increase in stiffness can be realized. These results are shown in FIG. 11, which adopts the same symbology used in FIG. 9.

Figure 12:
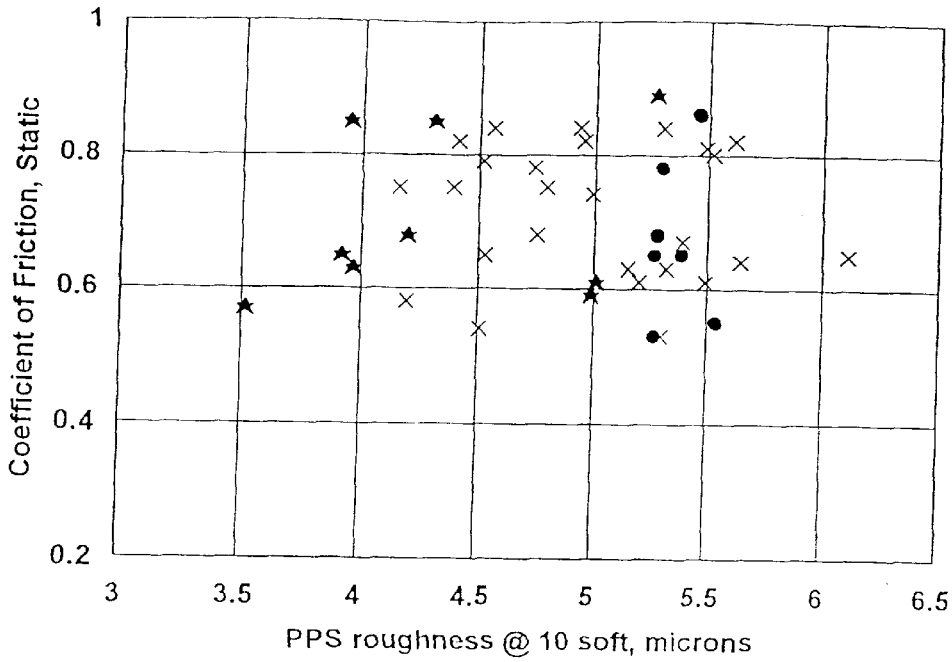
FIG. 12 is a graph showing the effect of conventional steel-on-steel hard calendering (λ), soft nip calendering (H) and shoe nip calendering (5) on coefficient of friction of envelope paper.
Figure 13:
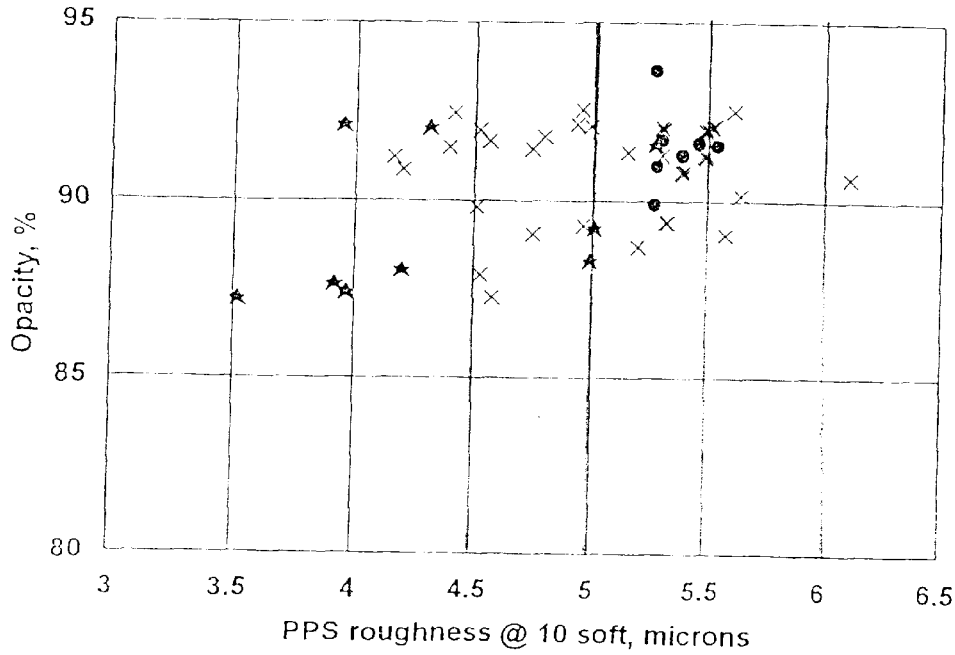
FIG. 13 is a graph showing the effect of conventional steel-on-steel hard calendering (λ), soft nip calendering (H) and shoe nip calendering (5) on opacity of envelope paper.

Paper properties important to the convertibility and use of envelope paper, such as coefficient of friction and opacity, were not harmed by shoe nip calendering to various levels. This is shown in FIGS. 12 and 13.

Figure 14:
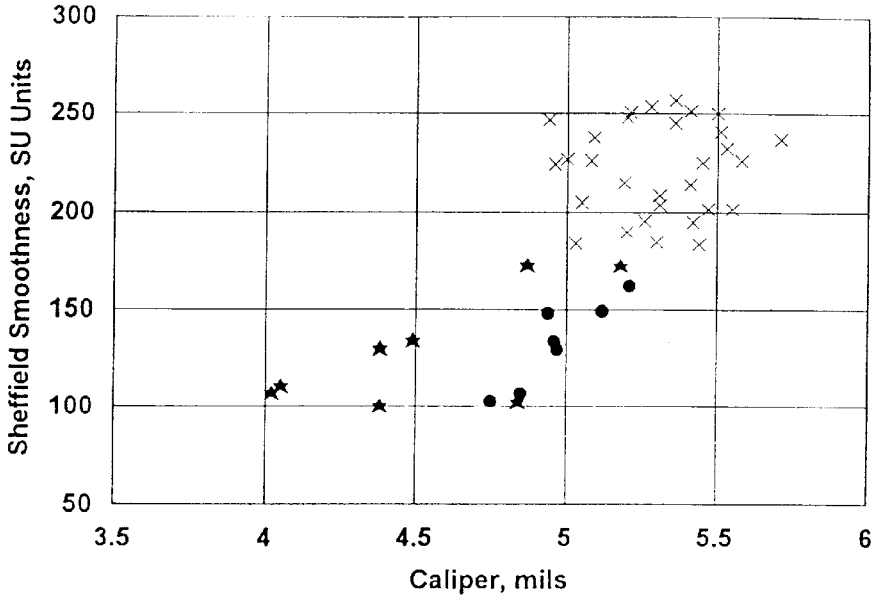
FIG. 14 is a graph showing the effect of conventional steel-on-steel hard calendering (λ), soft nip calendering (H) and shoe nip calendering (5) on Sheffield smoothness of envelope paper.

Shoe-nip-calendered envelope paper remains rough on a macroscale, as measured with the Sheffield smoothness tester, as shown in FIG. 14. A higher Sheffield number is associated with a rougher sheet on a macroscale. This is an advantage for envelope papers in the sense that the shoe-nip-calendered paper does not feel overly smooth and slippery to touch, which will be welcomed by envelope converters.

Figure 15:
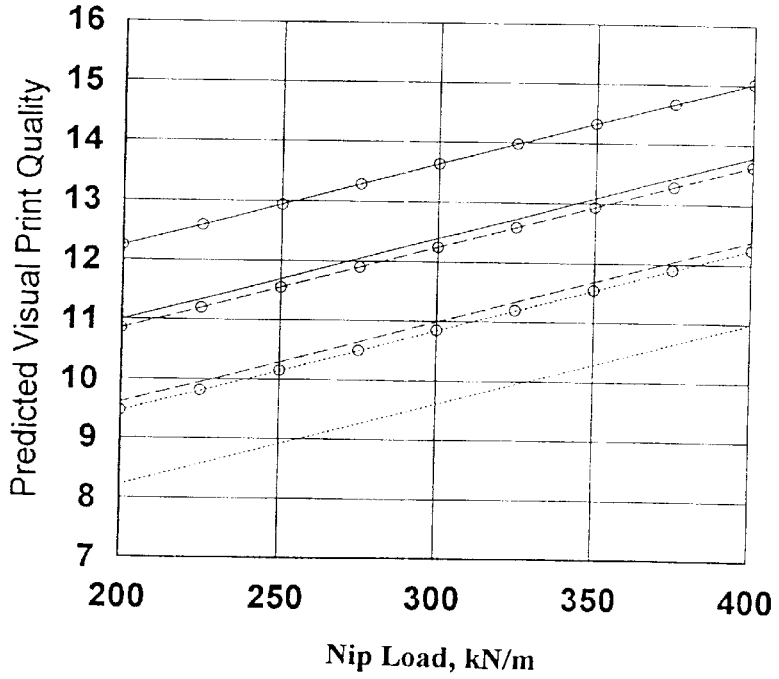
FIG. 15 is a graph showing the visual print quality predicted by regression analysis of data acquired at different temperatures, pressures and steam levels. The lines with circles and without circles represent predicted data at temperatures 385° and 302° F. respectively; the solid lines correspond to a steam level of 4 g/m$^2$, the broken lines correspond to a steam level of 2 g/m$^2$, while the dashed lines correspond to no steam.

Finally, FIG. 15 is a graph showing the results of a regression analysis based on actual data. Each line shows the predicted visual print quality as a function of nipload for different sets of roll temperature and steam levels. The solid line with circles corresponds to a temperature of 385° F. and a steam level of 4 g/m$^2$; the broken solid line with circles corresponds to a temperature of 385° F. and a steam level of 2 g/m$^2$; the dashed line with circles corresponds to a temperature of 385° F. without steam; the solid line without circles corresponds to a temperature of 302° F. and a steam level of 4 g/m$^2$; the broken solid line without circles corresponds to a temperature of 302° F. and a steam level of 2 g/m$^2$; and the dashed line without circles corresponds to a temperature of 302° F. without steam. It can be seen that the print quality increases with increasing pressure, increasing temperature and increasing steam level.

One possible variation of the invention involves eliminating the size press operation and calendering a product that is not surface sized. Another variation involves calendering the paper ahead of the belted nips with a steel nip which can be used to control the caliper of the board. The steel nip can be heated using controlled zone heating such as that provided by commercially available induction heating systems. Alternatively, the nip loading mechanism could be such that a profile can be maintained to reduce caliper variation across the web. Yet another variation of the proposed process would involve performing the caliper profiling in the extended nip. This can be accomplished by zone-controlled heating on the finishing roll and also varying the applied pressure across the width by hydraulic means. Another variation of this invention is to add moisture in such a way that the additional drying capacity of the intercalender dryers is used for improving the speed of the machine.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. An uncoated paper product having a density equal to or less than 0.75 g/cc and having a finished surface with the following properties:

(a) a Sheffield smoothness greater than about 200 Sheffield units; and (b) a Parker Print Surf roughness less than about 5.0 microns.

2. The paper product as recited in claim 1 having a basis weight in the range of 16 to 32 pounds per 1,300 square feet.

3. The paper product as recited in claim 2 having a Gurley stiffness in the machine direction in the range of 60 to 500 mgf.

4. The paper product as recited in claim 3 having a Gurley stiffness in the cross direction in the range of 30 to 350 mgf.

5. An uncoated paper product having a density equal to or less than 0.75 g/cc, a Sheffield smoothness of greater than about 200 Sheffield units, and a Parker Print Surf roughness less than about 5.0 microns, and having a surface which is finished by a method comprising the step of extended nip calendaring.

6. The paper product as recited in claim 5, wherein said step of extended nip calendering comprises the steps of backing a soft belt using a shoe and pressing said soft belt against a heated roll with the paper therebetween.

7. The paper product as recited in claim 6, wherein the roll surface temperature during said shoe nip calendering is greater than 250° F.

8. The paper product as recited in claim 7, wherein the applied nipload during said shoe nip calendering is in the range of 250 to 450 kN/m with a nip width of 1 to 25 cm.

9. The paper product as recited in claim 6, wherein the applied nipload during said shoe nip calendering is in the range of 250 to 450 kN/m with a nip width of 1 to 25 cm.

10. The paper product as recited in claim 5, wherein said finishing method further comprises the step of applying steam to said surface to be finished prior to the extended nip, steam being applied at a level in the range of 0.5 to 5 g/m$^2$.

11. The paper product as recited in claim 5, wherein said finishing method further comprises the step of applying liquid water to said surface to be finished prior to the extended nip, liquid water being applied at a level in the range of 0.5 to 5 g/m$^2$.

* * * * *